US009144706B1

(12) United States Patent
Maresh et al.

(10) Patent No.: US 9,144,706 B1
(45) Date of Patent: Sep. 29, 2015

(54) EXERCISE APPARATUS

(76) Inventors: Joseph D Maresh, West Linn, OR (US); Kenneth W Stearns, Houston, TX (US)

( * ) Notice: Subject to any disclaimer, the term of this patent is extended or adjusted under 35 U.S.C. 154(b) by 45 days.

(21) Appl. No.: 13/469,225

(22) Filed: May 11, 2012

Related U.S. Application Data

(60) Provisional application No. 61/518,811, filed on May 12, 2011.

(51) Int. Cl.
*A63B 22/04* (2006.01)
*A63B 22/00* (2006.01)
*A63B 22/06* (2006.01)

(52) U.S. Cl.
CPC ..... *A63B 22/04* (2013.01); *A63B 22/0664* (2013.01); *A63B 2022/067* (2013.01)

(58) Field of Classification Search
CPC .... A63B 22/04; A63B 22/06; A63B 22/0664; A63B 2022/067
USPC ..... 482/51–53, 57, 70, 79, 80
See application file for complete search history.

(56) References Cited

U.S. PATENT DOCUMENTS

| | | | | |
|---|---|---|---|---|
| 2,648,330 | A | 8/1952 | Clark | |
| 5,279,529 | A | 1/1994 | Eschenbach | |
| 5,735,774 | A | 4/1998 | Maresh | |
| 5,935,046 | A | 8/1999 | Maresh | |
| 6,206,804 | B1 | 3/2001 | Maresh | |
| 6,544,146 | B1 * | 4/2003 | Stearns et al. | 482/52 |
| 6,846,273 | B1 | 1/2005 | Stearns et al. | |
| 7,033,305 | B1 * | 4/2006 | Stearns et al. | 482/52 |
| 7,112,161 | B2 | 9/2006 | Maresh | |
| 7,153,239 | B1 | 12/2006 | Stearns et al. | |
| 7,341,542 | B2 * | 3/2008 | Ohrt et al. | 482/52 |
| 7,344,480 | B2 | 3/2008 | Maresh et al. | |
| 7,670,268 | B1 | 3/2010 | Stearns et al. | |
| 7,918,766 | B2 * | 4/2011 | Lu et al. | 482/52 |
| 8,292,789 | B2 | 10/2012 | Maresh et al. | |
| 2002/0094914 | A1 * | 7/2002 | Maresh et al. | 482/51 |
| 2005/0043148 | A1 * | 2/2005 | Maresh | 482/70 |
| 2006/0247103 | A1 * | 11/2006 | Stearns et al. | 482/52 |
| 2009/0048077 | A1 * | 2/2009 | Chuang et al. | 482/62 |
| 2009/0209395 | A1 * | 8/2009 | Maresh et al. | 482/52 |
| 2009/0291808 | A1 * | 11/2009 | Chen | 482/52 |

* cited by examiner

*Primary Examiner* — Loan H Thanh
*Assistant Examiner* — Gregory Winter
(74) *Attorney, Agent, or Firm* — Nick A Nichols, Jr.

(57) ABSTRACT

An exercise apparatus may provide a novel linkage assembly suitable for linking circular motion to relatively more complex, generally elliptical motion. Left and right rocker links may be rotatably mounted on a frame rotatable about a first axis. Left and right rocker linkages may be mounted on the frame rotatable about a second axis. Left and right force receiving members may be movably connected between respective rocker links and rocker linkages in such a manner that the force receiving members move through paths of motion which are fixed, adjustable or variable.

7 Claims, 9 Drawing Sheets

EXERCISE APPARATUS

CROSS-REFERENCE TO RELATED APPLICATION

This application claims the benefit of U.S. Provisional Application Ser. No. 61/518,811, filed May 12, 2011, which application is incorporated herein in its entirety by reference.

BACKGROUND

The present invention relates to fitness machines, and in particular fitness machines that constrain a user's feet and/or arms to travel along variable or fixed paths.

Exercise equipment has been designed to facilitate a variety of exercise motions (including treadmills for walking or running in place; stepper machines for climbing in place; bicycle machines for pedaling in place; and other machines for skating and/or striding in place. Yet another type of exercise equipment has been designed to facilitate relatively more complicated exercise motions and/or to better simulate real life activity. Such equipment converts a relatively simple motion, such as circular, into a relatively more complex motion, such as elliptical. Despite various advances in the elliptical exercise category, room for improvement remains.

SUMMARY

An exercise apparatus may provide a novel linkage assembly suitable for linking circular motion to relatively more complex, generally elliptical motion. Left and right rocker links may be rotatably mounted on a frame rotatable about a first axis. Left and right rocker linkages may be mounted on the frame rotatable about a second axis. Left and right force receiving members may be movably connected between respective rocker links and rocker linkages in such a manner that the force receiving members move through paths of motion which are fixed, adjustable or variable.

BRIEF DESCRIPTION OF THE DRAWINGS

So that the manner in which the above recited features, advantages and objects of the present invention are attained can be understood in detail, a more particular description of the invention briefly summarized above, may be had by reference to the embodiments thereof which are illustrated in the appended drawings.

It is noted, however, that the appended drawings illustrate only typical embodiments of this invention and are therefore not to be considered limiting of its scope, for the invention may admit to other equally effective embodiments.

DETAILED DESCRIPTION

Figure 1:
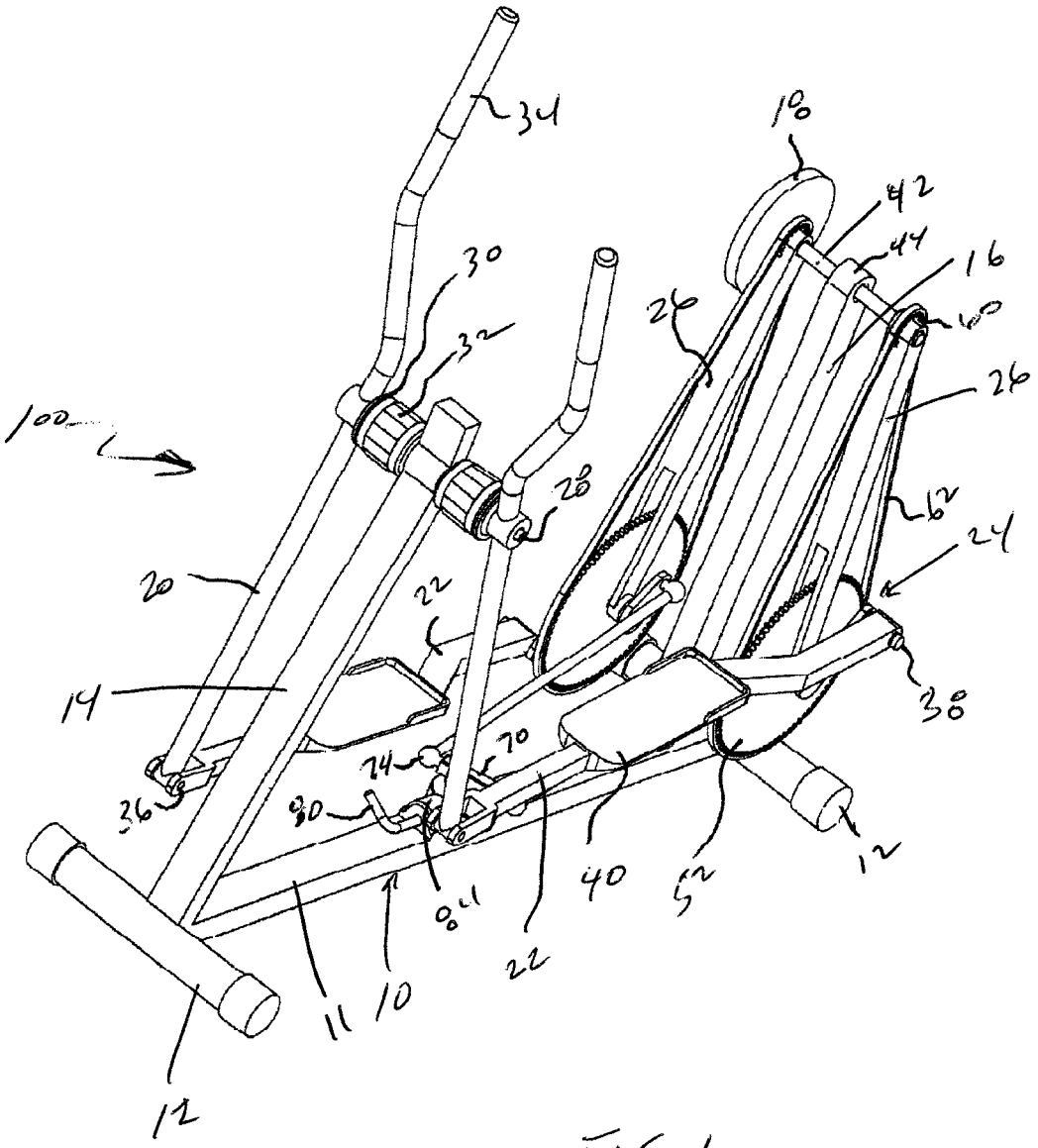
FIG. 1 is a perspective view of a first embodiment of an exercise apparatus.

Elliptical motion exercise apparatus may link rotation of left and right cranks to generally elliptical motion of respective left and right foot supports. The term "elliptical motion" is intended in a broad sense to describe a closed path of motion having a relatively longer major axis and a relatively shorter minor axis. In general, displacement of the cranks move the foot supports in a direction coincidental with one axis of the elliptical path, and displacement of crank driven members move the foot supports in a direction coincidental with the other axis. A general characteristic of elliptical exercise apparatus may be that the crank diameter determines the length of one axis, but does not determine the length of the other axis. As a result of this feature, a user's feet may travel through a generally elliptical path having a desirable aspect ratio, and the apparatus that embody this technology may be made relatively more compact, as well. The embodiments shown and/or described herein are generally symmetrical about a vertical plane extending lengthwise through a floor-engaging base (perpendicular to the transverse ends thereof). In general, the "right-hand" components are one hundred and eighty degrees out of phase relative to the "left-hand" components. Like reference numerals are used to designate both the "right-hand" and "left-hand" parts, and when reference is made to one or more parts on only one side of an apparatus, it is to be understood that corresponding part(s) are disposed on the opposite side of the apparatus. Also, to the extent that reference is made to forward or rearward portions of an apparatus, it is to be understood that a user can typically exercise on such apparatus while facing in either direction relative to the linkage assembly.

Referring first to FIG. 1, a first embodiment of an elliptical exercise apparatus is generally denoted by the reference numeral 100. The apparatus 100 includes a frame 10 that is designed to rest upon a floor surface. The frame 10 may include a generally I-shaped base that may include an elongate base member 11 and transversely oriented base members 12 fixedly secured to the opposite ends of the base member 11. A forward stanchion 14 extends upward from proximate a forward end of the frame 10 and a rearward stanchion 16 extends upward from proximate an opposite, rearward end of the frame 10. The apparatus 100 is generally symmetrical about a vertical plane extending lengthwise through the frame 10, perpendicular to the transverse base members 12 at each end thereof, the only exceptions being a flywheel 18 and the relative orientation of certain parts of the linkage assembly on opposite sides of the plane of symmetry.

Those skilled in the art will also recognize that the portions of the frame 10 which are intersected by the plane of symmetry exist individually and thus, do not have any "opposite side" counterparts. Moreover, although reference is made to forward and rearward portions of the apparatus 100, a user may exercise while facing toward either the front or rear of the frame 10. A linkage assembly is mounted on each side of the apparatus 100. The linkage assembly may generally include a forward rocker link 20, a force receiving link 22, a crank assembly 24, and a rear rocker link 26. The forward rocker link 20 is rotatably mounted to the forward stanchion 14 at handle bar shaft 28. A friction disk 30 and grip ring 32 may be mounted between the front rocker link 20 and the forward stanchion 14. Friction resistance may be adjusted by tightening or loosening the grip ring 32. An upper end of each rocker link 20 may be sized and configured for grasping by a user standing on the force receiving links 22.

A forward proximal end of each force receiving link 22 is rotatably connected to a lower distal end of respective forward rocker links 20 at bearing 36. A rearward distal end of each force receiving link 22 is rotatably secured to a respective crank assembly 24 at bearing 38. Foot platforms 40 sized and configured to support a user's foot are rigidly secured to respective force receiving links 22.

Figure 2:
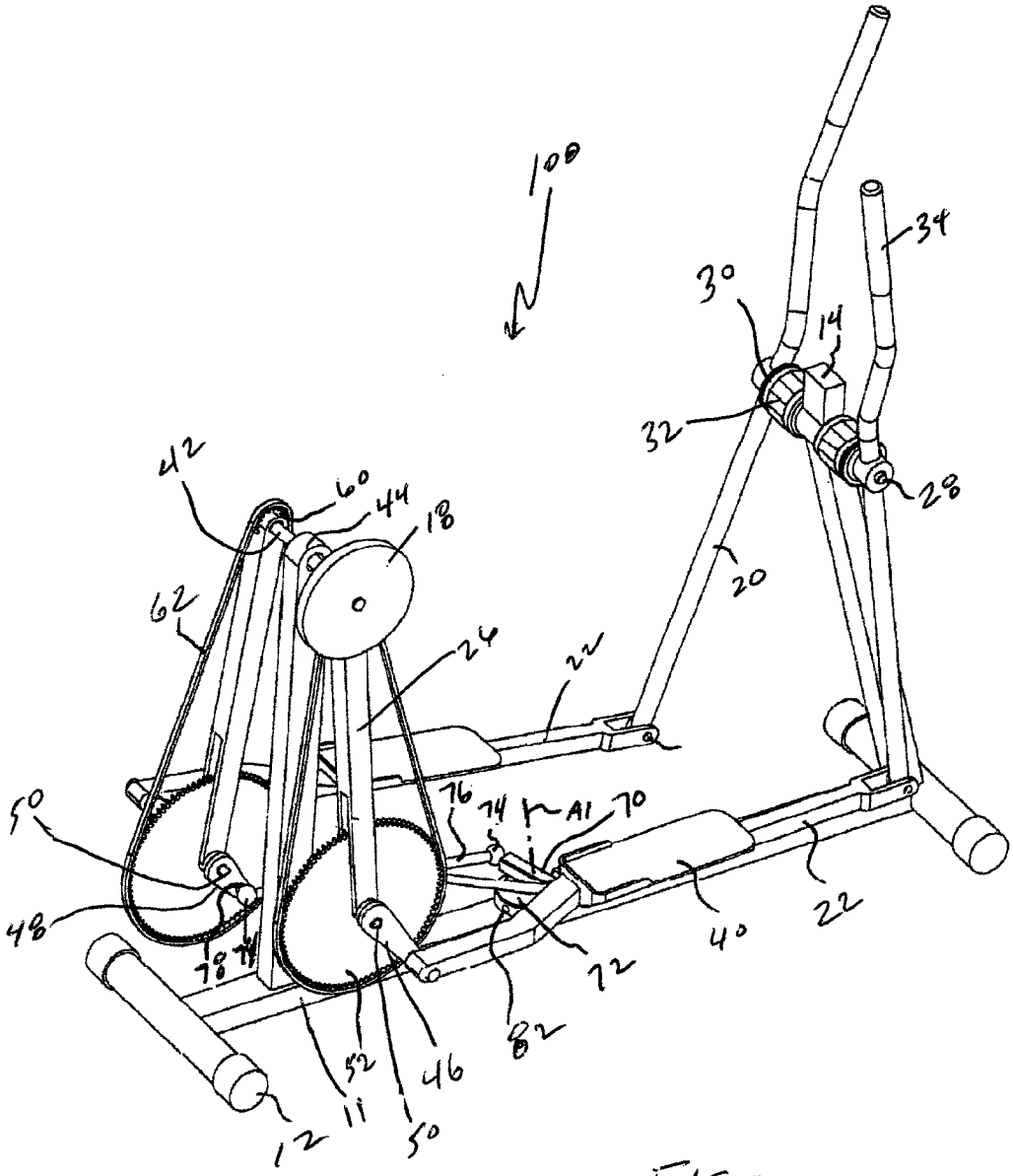
FIG. 2 is a perspective view taken from the opposite side of the exercise apparatus shown in FIG. 1.
Figure 3:
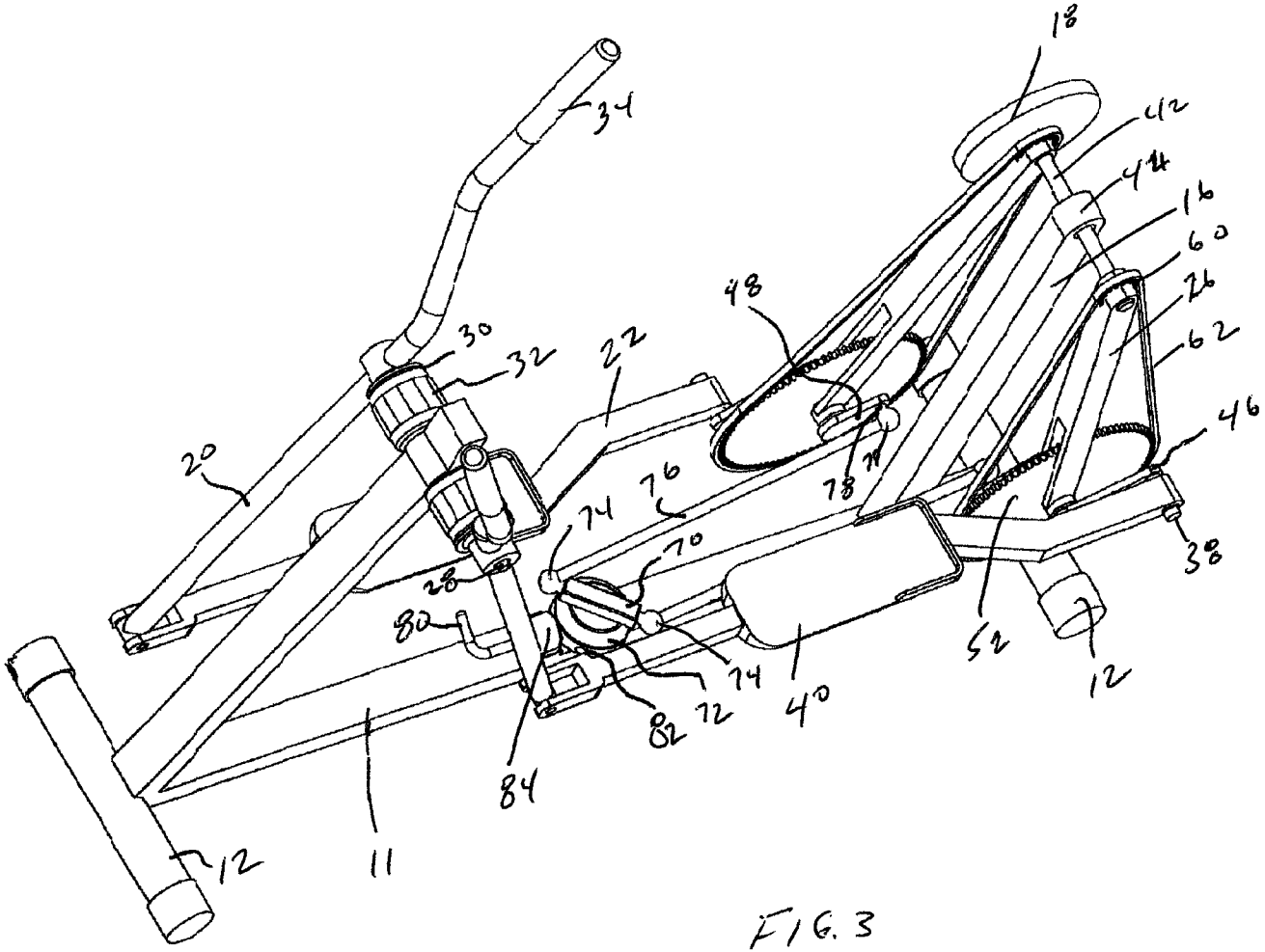
FIG. 3 is a perspective view of the exercise apparatus shown in FIG. 1 depicting the exercise apparatus operating in an active mode at a first instant in time.
Figure 4:
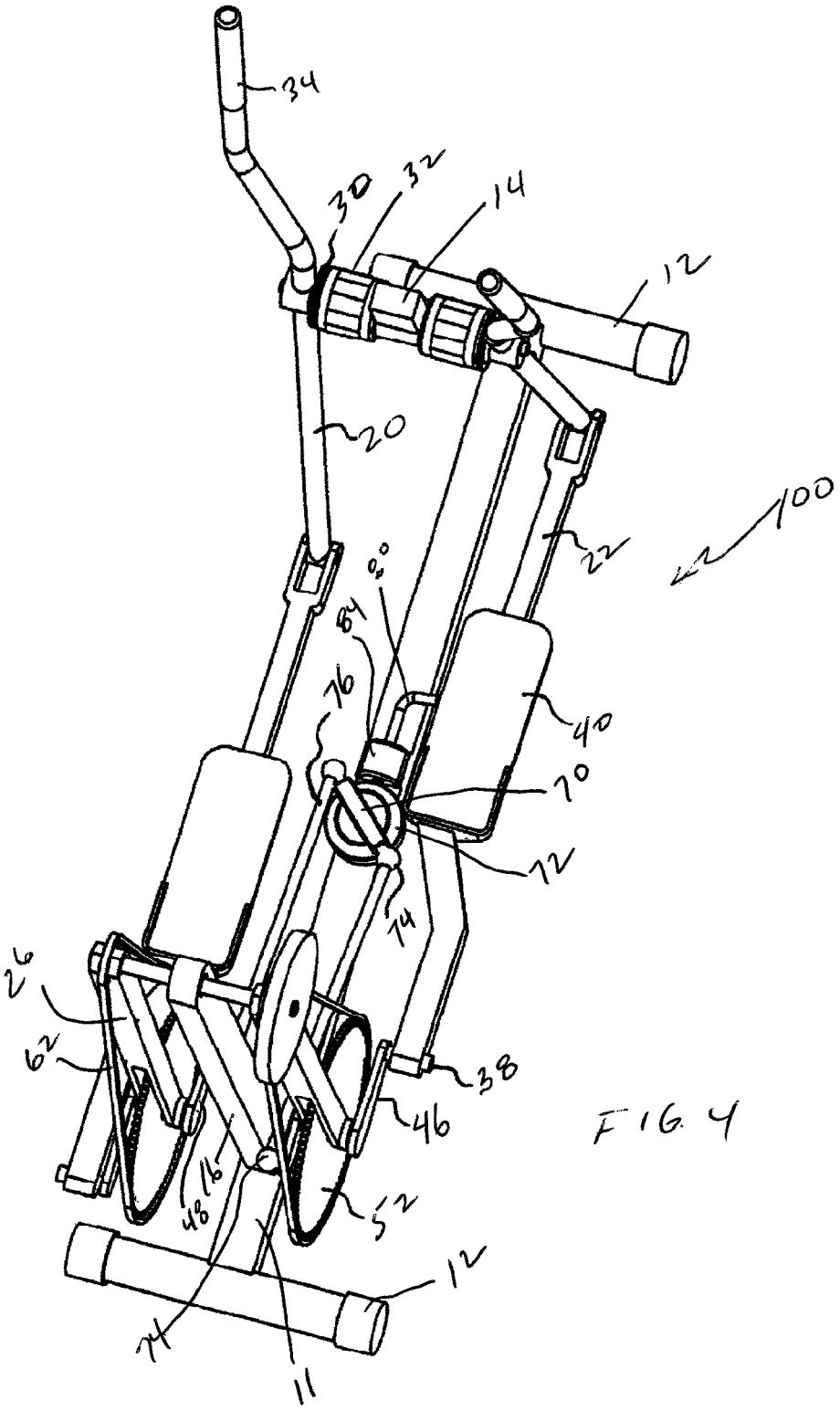
FIG. 4 is a perspective view of the exercise apparatus shown in FIG. 1 depicting the exercise apparatus operating in an active mode at a second instant in time.
Figure 5:
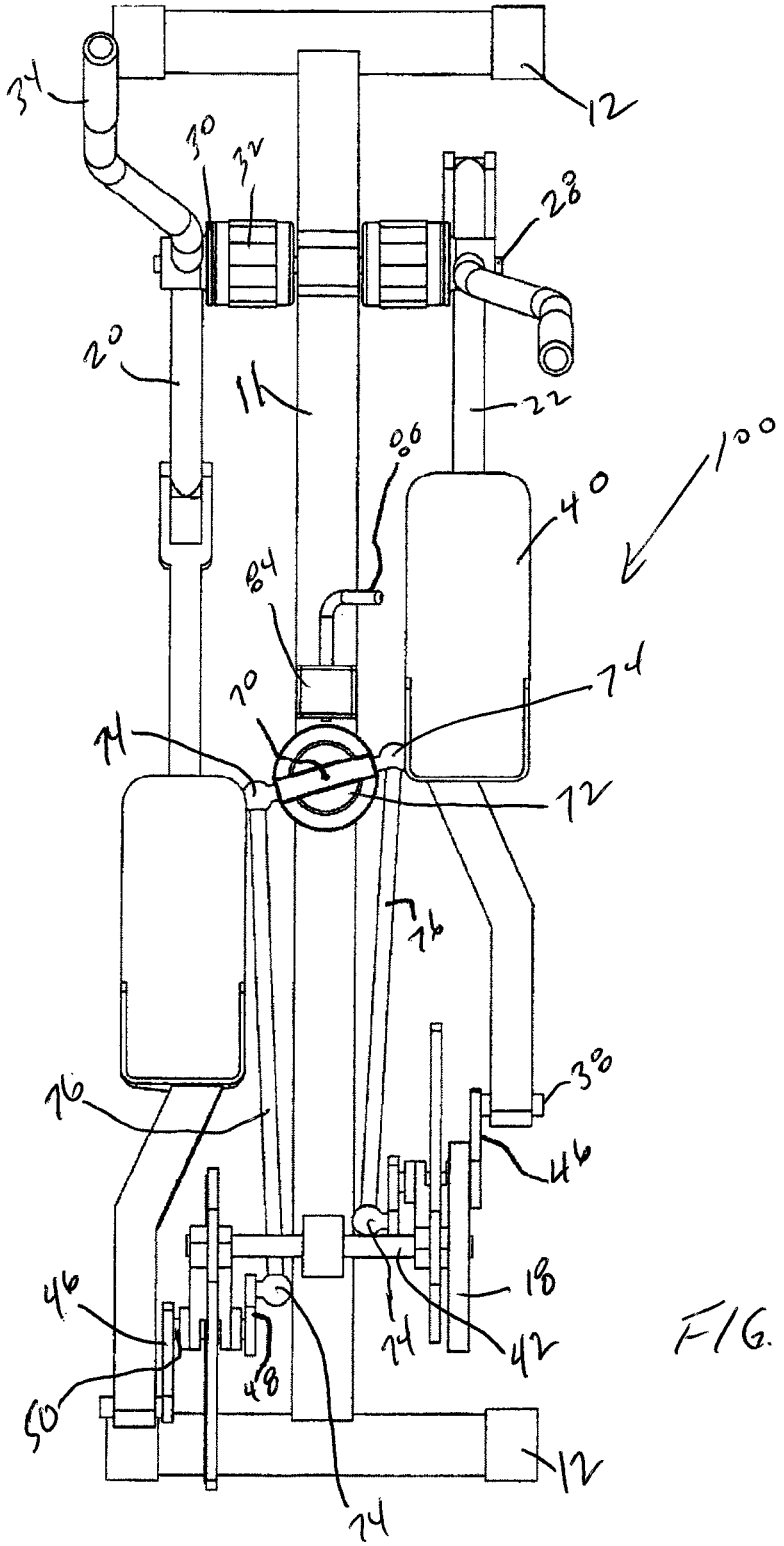
FIG. 5 is a top plan view of the exercise apparatus shown in FIG. 2.

Referring now to FIG. 2, each crank assembly 24 mounted on each side of the apparatus 100 may generally include an outer crank 46 and an inner crank 48 rotatably mounted on a lower distal end of a respective rear rocker link 26 via a common shaft 50. Each crank assembly 24 may further include a disk gear 52 disposed between the outer crank 46 and the inner crank 48 fixedly secured to the shaft 50. The outer crank 46, disk gear 52 and inner crank 48 are keyed to the shaft 50 to rotate together. Bearings may be disposed between the rear rocker links 26 and the shaft 50 to allow the crank assemblies 24 to freely rotate relative to the rear rocker links 26.

Referring again to FIG. 1, a rear rocker link 26 is mounted on each side of the apparatus 100. The rocker links 26 are operatively connected to the rear stanchion 16 via a common shaft 42 rotatably secured to the rear stanchion 16 at bearing 44. Bearings may be disposed between the rear rocker links 26 and the shaft 42 to allow the rocker links 26 to freely rotate relative to the shaft 42. Bearings may also be disposed between the shaft 42 and the rear stanchion 16 to allow the shaft 42 to freely rotate relative to the rear stanchion 16. Sprocket 60 may be keyed to the opposite ends of the shaft 42. The flywheel 18 may also be keyed to the shaft 42 to rotate together with the shaft 42 and sprockets 60. A conventional drag strap or other known resistance device may be connected to the flywheel 18 to provide resistance to rotation.

Each disk gear 52 includes gear teeth disposed about its circumference and is connected to a respective sprocket 60 by a roller chain 62 (or timing/synchronization belt) thereby maintaining synchronized rotation and nearly constant orientation of the left and right crank assemblies 24. The disk gears 52 are significantly larger in diameter than the sprockets 60 and cooperate therewith to provide a stepped up flywheel arrangement. The common shaft 42 extending between the sprockets 60 links rotation of the left crank assembly 24 to rotation of the right crank assembly 24.

The rear rocker links 26 are interconnected to move in dependent fashion in opposite directions relative to one another. A cross coupler 70 is rotatably mounted on an upstanding post (not shown in the drawings) on the base frame member 11 and rotatable relative thereto about a vertical axis. The cross coupler 70 may be rigidly mounted on a coupler hub 72. Friction disks may be disposed between the coupler hub 72 and the base frame member 11 to establish rotational resistance of the cross coupler 70. The cross coupler 70 includes ball joints 74 secured at the distal ends of the cross coupler 70. The inner cranks 48 of the crank assemblies 24 include similar ball joints 74 secured at the distal ends thereof. Coupler rods 76 connect the cross coupler 70 to the inner cranks 48. Right and left coupler rods 76 connect respective right and left paired ball joints 74 such that the distance between right and left paired ball joints 74 remains constant. Cross coupler 70 may have the ball joints 74 bolted thereto, while the ball joints 74 at the inner crank 48 may be secured to a rotatable stud shaft 78, more clearly shown in FIG. 2. The stud shaft 78 may be rotatably connected to the inner crank 48 with a ball bearing connector or the like to accommodate the rotational motion of the crank 48. Ball bearing connectors may not be utilized at the cross coupler ball joints 74 as the cross connect 70 reciprocally pivots about its rotational vertical axis.

The apparatus 100 may operate in active and passive modes. While exercising in the active mode, the range of motion experienced by a user is a function of user applied force, whereby cross coupler 70 reciprocally rotates in one direction or the other, to different degrees, dependent upon the magnitude of the user applied force. The variability of size or length of the foot path is substantial, and the foot path may be characterized as ranging from stepping motion to striding motion.

Figure 6:
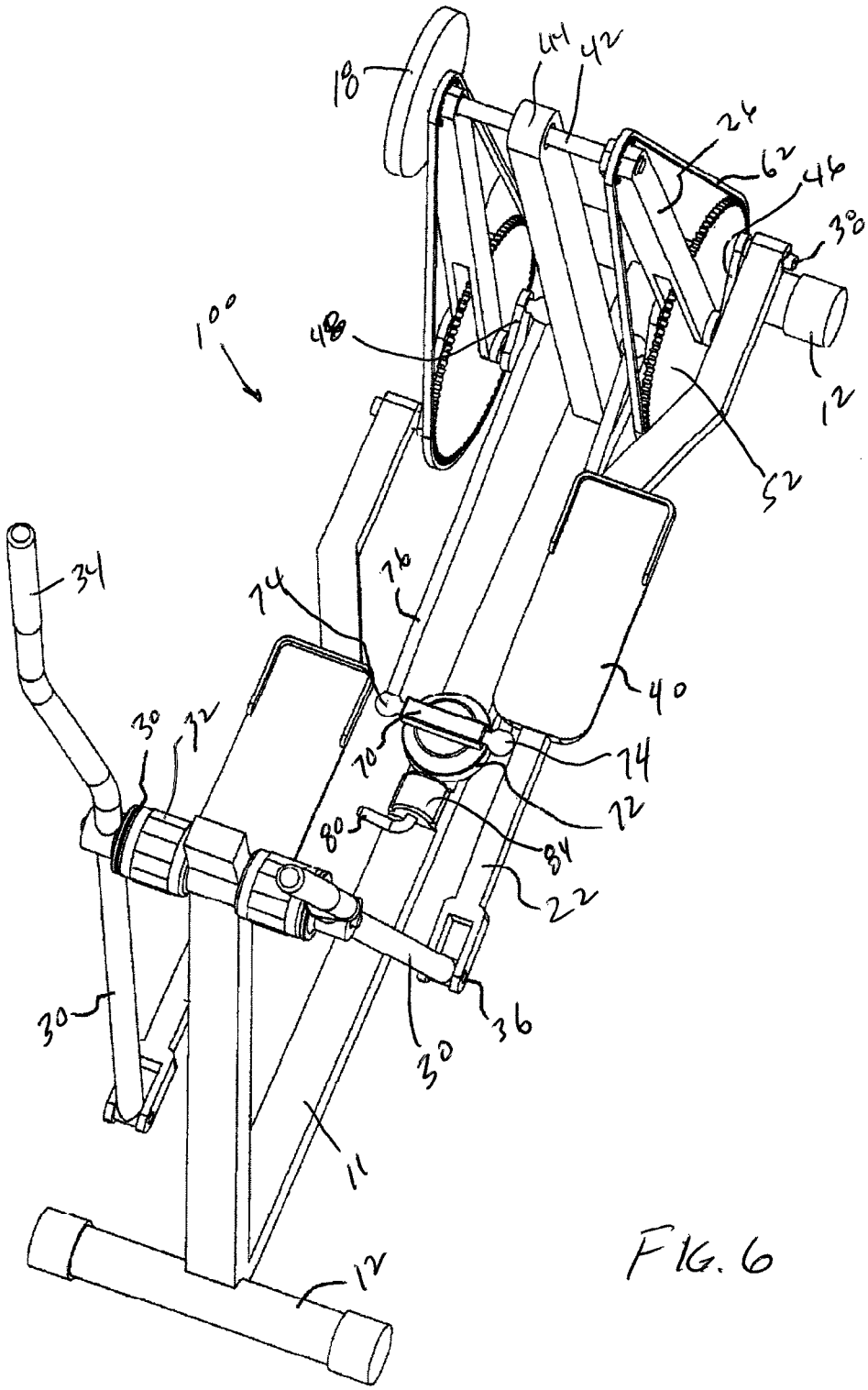
FIG. 6 is a perspective view of the exercise apparatus shown in FIG. 1 depicting the exercise apparatus operating in a passive, fixed path mode.

When the exercise apparatus 100 is configured for use in the passive mode, shown in FIG. 6, the cross coupler 70 is oriented transverse to the base frame member 12 and locked against reciprocal rotation by inserting a lock pin 80 in a hole 82, best shown in FIG. 2, formed in the cross coupler hub 72. The pin 80 is supported by a bracket 84 or similar supporting structure mounted on the base frame member 12 in alignment with the hole 82 in the cross coupler hub 72. The lock pin 80 may be selectively inserted through the hole 82 and the distal end thereof received in a corresponding aligned hole in the post rotationally connecting the cross coupler 70 on the base frame member 12. In the passive mode, the size of the foot/arm path is constant and does not change as a function of user applied force.

Figure 7:
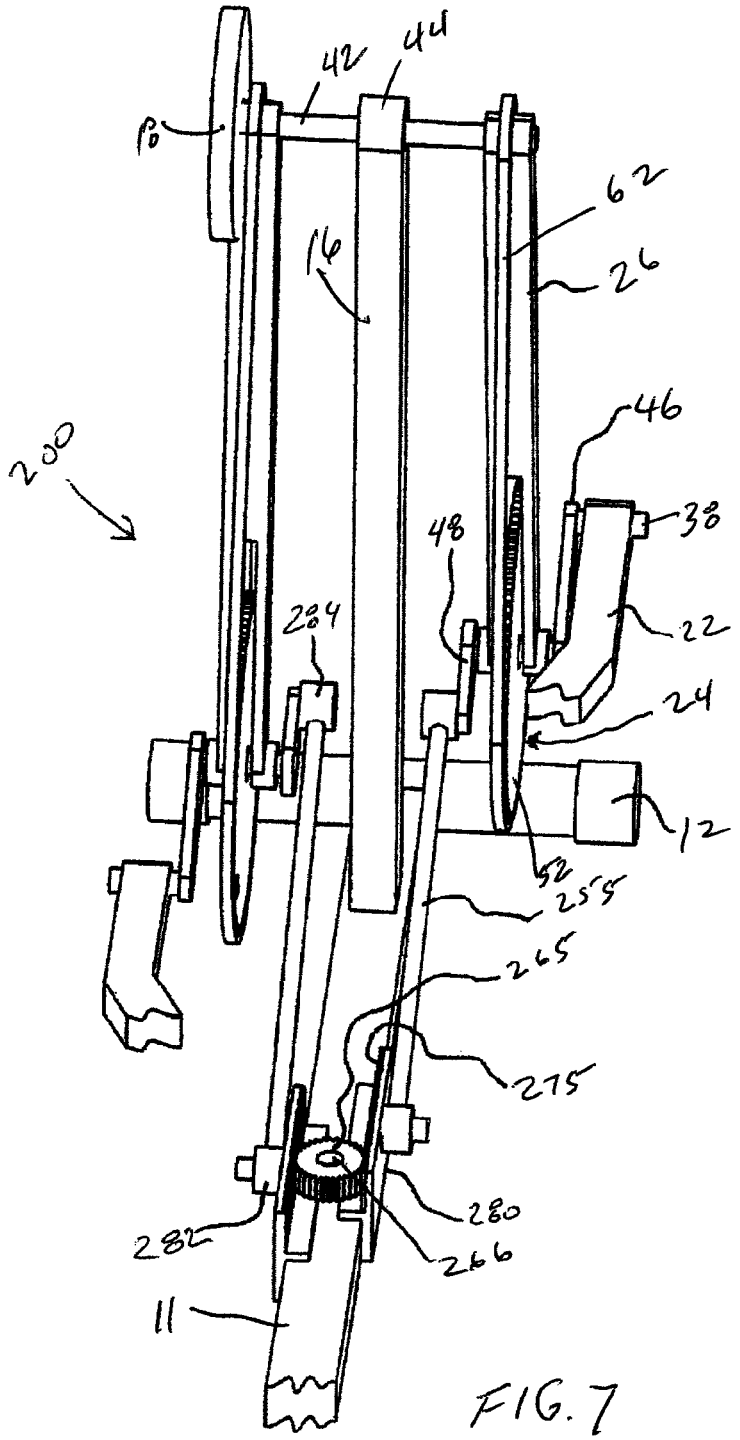
FIG. 7 is a fragmentary perspective view of a second embodiment of an exercise apparatus.

Referring now to FIG. 7, a second embodiment of an elliptical exercise apparatus is generally denoted by the reference numeral 200. The apparatus 200 is substantially the same as the apparatus 100 described above with the exception that a rack and pinion arrangement is utilized as a cross coupler. Like or corresponding reference numerals are used to designate like or corresponding parts. The rack and pinion arrangement includes a pinion gear 265 rotatably mounted on the base frame member 11 about a pinion post 266. Slide blocks 280 are slidably mounted on the base frame member 11. Rack teeth 275 on the slide blocks 280 operatively engage the pinion gear 265. Coupler rods 255 connect slide blocks 280 to the inner crank 48 of the crank assembly 24. One end of the coupler rods 255 is connected to a respective slide block 280 at a bearing 282 and the opposite end of the coupler rods 255 is connected to a respective inner crank 48 at a bearing 284. The slide blocks 280 move in opposite directions to a distance proportional to the amount of user applied force. While in the passive mode, the slide blocks 280 are laterally coincidently aligned and locked to the base frame member 11.

Figure 8:
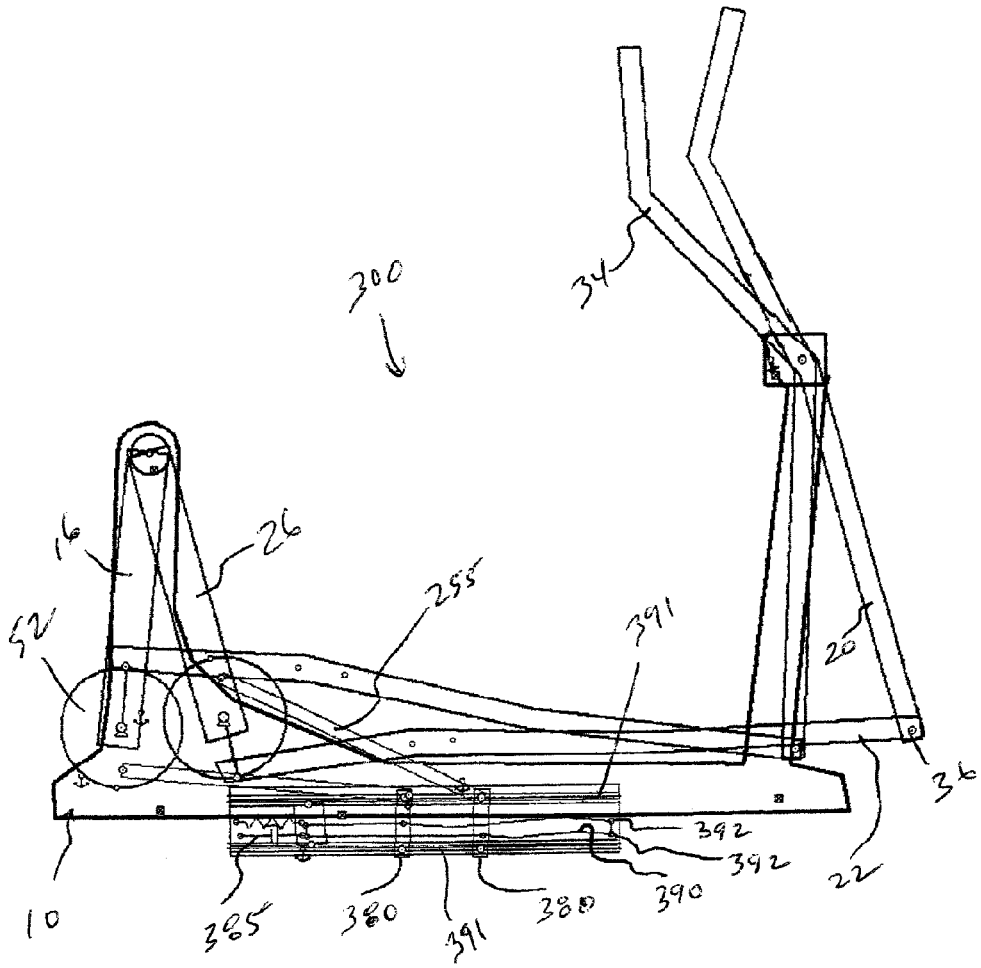
FIG. 8 is a screen page from a working model program illustrating a third embodiment of an exercise apparatus.

Referring now to FIG. 8, a third embodiment of an elliptical exercise apparatus is generally denoted by the reference numeral 300. The apparatus 300 is substantially the same as the apparatus 200 described above with the exception that a looped cable circuit may be employed to cause synchronized opposite reciprocating action of slide blocks. Like or corresponding reference numerals are used to designate like or corresponding parts. In the apparatus 300 shown in FIG. 8, slide blocks 380 are constrained to move along upper and lower races 391 formed on the apparatus frame 10. A cable 390 is looped through pulleys 392 mounted on the frame 10, while also being secured to slide blocks 380 such that right and left slide blocks 380 are attached to the region of the cable loop which corresponds to opposite and reciprocating motion of the right and left slide blocks 380. The cable 390 may also optionally be looped through a resistance device such as a damper and/or a spring 385.

The range of motion of rear rocker links 26 will be variable in part due to the instantaneous relative positions of slide blocks 380, in addition to the orientation of the outer crank rods 46. The reader will note that lateral rockers, and/or hydraulic/pneumatic and/or electro mechanical components may alternatively be used to effect the forward instantaneous rotational axis location of coupler rods 255. Furthermore, the slide blocks 280, 380, or cross coupler 70, may be controlled by a computer program which alters the size of the user motion path. Additionally, an electric motor may be used in substitution of the flywheel 18.

Figure 9:
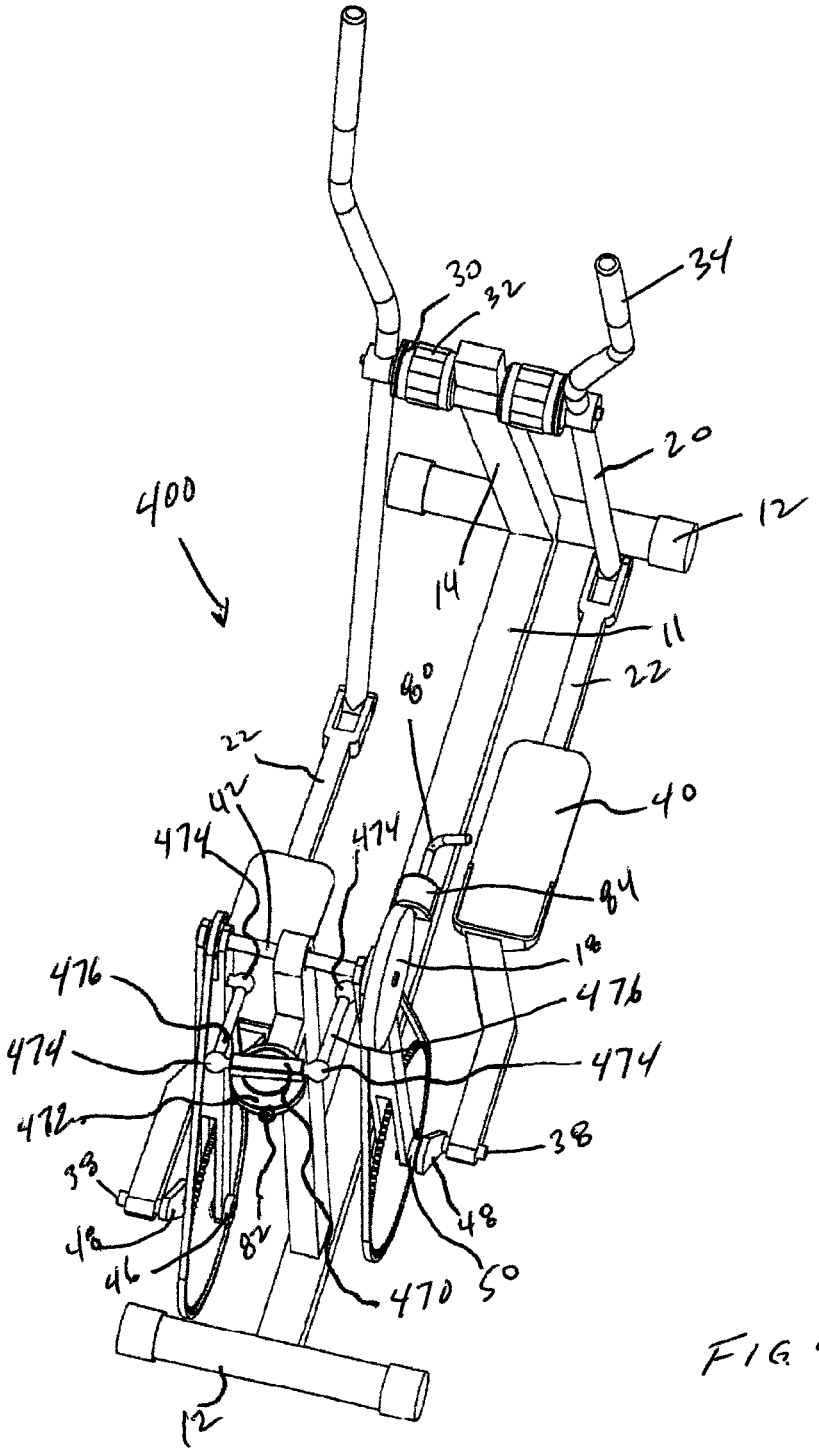
FIG. 9 is a perspective view of a fourth embodiment of an exerciser apparatus.

Referring now to FIG. 9, a fourth embodiment of an elliptical exercise apparatus is generally denoted by the reference numeral 400. The apparatus 400 is substantially the same as the apparatus 100 described above with the exception that the cross coupler is mounted on the apparatus frame operatively connected to the rear rocker links 26. Like or corresponding reference numerals are used to designate like or corresponding parts.

Referring still to FIG. 9, the cross coupler 470 is rigidly secured to a cross coupler hub 472 mounted on the rear stanchion 16 of the apparatus 400 and rotatable relative thereto about a generally vertical axis. The cross coupler 470 includes ball joints 474 secured at the opposed distal ends thereof. Coupler rods 476 connect the cross coupler 470 to the rear rocker links 26 at similar ball joints 474 secured at an intermediate portion of the rear rocker links 26. The rear rocker links 26 are interconnected to move in dependent fashion in opposite directions relative to one another as a function of user applied force. Friction disks may be disposed between the coupler hub 472 and the stanchion 16 to establish rotational resistance of the cross coupler 470. Alternatively, the angular orientation of cross coupler 470 relative to the rear stanchion 16 may be electronically controlled in order to effect foot path shape. Foot path shapes may range from near arcuate stepping to long running or gliding paths. Additionally, brakes or other resistance means may be incorporated with the cross coupler 470 to alter the general foot path shape or force characteristics.

While a preferred embodiment of the invention has been shown and described, other and further embodiments of the invention may be devised without departing from the basic scope thereof, and the scope thereof is determined by the claims which follow.

The invention claimed is:

1. An exercise apparatus, comprising:

a) a frame configured to rest on a floor surface, said frame including a forward stanchion fixedly secured proximate a front end of said frame and a rearward stanchion fixedly secured proximate a rear end of said frame;

b) a left forward rocker link and a right forward rocker link, wherein each said forward rocker link is mounted on a respective side of said frame;

c) a left rear rocker link and a right rear rocker link, wherein each said rear rocker link is mounted on a respective side of said frame;

d) a crank rotatably mounted on a distal end of each said rear rocker link;

e) a left force receiving link and a right force receiving link, wherein each said force receiving link is movably connected between a respective said forward rocker link and a respective said crank; and f) a cross coupler assembly including a cross coupler fixedly secured to a cross coupler hub pivotally connected to said rear stanchion pivotal about a transverse pivot axis, said cross coupler assembly further including a left and right coupler rod, each said coupler rod having a first end pivotally connected proximate a distal end of said cross coupler and a second end pivotally connected at an intermediate portion of a respective rear rocker link to move said left rear rocker link and said right rear rocker link in dependent fashion in opposite directions relative to said frame.

2. The exercise apparatus of claim 1 including a disk gear mounted on the distal end of each said rear rocker link, said crank and said disk gear keyed to a common shaft.

3. The exercise apparatus of claim 1 wherein said cross coupler assembly is selectively locked between a variable foot path mode and a fixed path mode, and wherein a foot path is variable as a function of user applied force.

4. The exercise apparatus of claim 2 wherein each said rear rocker link is rotatably connected to a transverse shaft rotatably connected to said rear stanchion.

5. The exercise apparatus of claim 4 including sprocket gears fixedly keyed to said transverse shaft proximate distal ends of said transverse shaft, wherein each said sprocket gear is operatively connected to a respective disk gear.

6. An exercise apparatus, comprising:

a) a frame configured to rest on a floor surface;

b) left and right linkages each including a plurality of links operatively supported on the frame, each of the linkages including at least:

(i) a first rocker link pivotally connected proximate a rear end of the frame;

(ii) a crank and a disk gear fixedly keyed to a shaft rotatably mounted proximate a lower distal end of the first rocker link;

(iii) a second rocker link pivotally connected proximate a front end of the frame; and (iv) a foot support member movably connected between the second rocker link and the crank; and c) a connector link assembly pivotally connected proximate the rear end of the frame, the connector link assembly including a connector link pivotal about a transverse pivot axis, a left and right coupler rod, each coupler rod having a first end pivotally connected proximate a distal end of the connector link and a second end pivotally connected at an intermediate portion of a respective first rocker link to move the first rocker link of the left and right linkages in dependent fashion in opposite directions relative to the frame.

7. The exercise apparatus of claim 6 wherein the connector link assembly is selectively movable to change the angular position of the connector link assembly relative to the frame to alter a foot path shape.

* * * * *